US008099946B2

(12) United States Patent
Hinz et al.

(10) Patent No.: US 8,099,946 B2
(45) Date of Patent: Jan. 24, 2012

(54) METHOD, DEVICE AND COMPUTER PROGRAM PRODUCT FOR DIAGNOSING AN OXIDATION CATALYST

(75) Inventors: Andreas Hinz, Onsala (SE); Lennart Andersson, Varberg (SE)

(73) Assignee: Volvo Lastvagnar AB, Göteborg (SE)

( * ) Notice: Subject to any disclaimer, the term of this patent is extended or adjusted under 35 U.S.C. 154(b) by 933 days.

(21) Appl. No.: 11/721,685

(22) PCT Filed: Dec. 14, 2004

(86) PCT No.: PCT/SE2004/001902
§ 371 (c)(1),
(2), (4) Date: May 5, 2008

(87) PCT Pub. No.: WO2006/065179
PCT Pub. Date: Jun. 22, 2006

(65) Prior Publication Data

US 2008/0302085 A1 Dec. 11, 2008

(51) Int. Cl.
*F01N 3/00* (2006.01)

(52) U.S. Cl. ..... 60/277; 60/274; 60/276; 60/286; 60/295; 60/297

(58) Field of Classification Search ..... 60/274, 60/276, 277, 286, 295, 297, 301, 303; 422/169, 422/171, 172, 177, 182
See application file for complete search history.

(56) References Cited

U.S. PATENT DOCUMENTS 6,367,320 B1 4/2002 Kueper et al.
6,701,707 B1 3/2004 Upadhyay et al.
7,134,273 B2 * 11/2006 Mazur et al. ..... 60/286
7,390,469 B2 * 6/2008 Montreuil et al. ..... 423/213.2
7,610,750 B2 * 11/2009 Viola et al. ..... 60/286
7,617,672 B2 * 11/2009 Nishina et al. ..... 60/277
7,685,810 B2 * 3/2010 Hirata et al. ..... 60/277
(Continued)

FOREIGN PATENT DOCUMENTS

DE 19844178 A1 3/2000
DE 19926149 A1 12/2000
EP 1081346 A2 3/2001
(Continued)

OTHER PUBLICATIONS

International Search Report from corresponding International Application PCT/SE2005/001902.

*Primary Examiner* — Tu Nguyen
(74) *Attorney, Agent, or Firm* — WRB-IP LLP

(57) ABSTRACT

A method, a device and a computer program product for the diagnosis of an oxidation catalyst for the oxidation of NO into $NO_2$ in a motor vehicle is provided. An exhaust gas aftertreatment system includes at least the aforementioned oxidation catalyst and a particulate filter and/or an $NO_x$-reducing catalyst arranged downstream of the oxidation catalyst, and a predetermined quantity of a reducing agent is supplied to the exhaust system upstream of the oxidation catalyst, and the $NO_x$ content or $NO_2$ content is measured downstream of the oxidation catalyst. The method includes measuring a first value for the $NO_x/NO_2$ content at a point in time before the reduction agent is supplied to the exhaust gas system, measuring a second value for the $NO_x/NO_2$ content at a point in time during the period when the reduction agent is supplied to the exhaust gas system, and comparing the aforementioned values, in conjunction with which an indication of the impaired function of the oxidation catalyst is obtained when the difference between the aforementioned measured values is less than a predetermined first value.

14 Claims, 6 Drawing Sheets

U.S. PATENT DOCUMENTS

| | | | | |
|---|---|---|---|---|
| 8,006,481 | B2 * | 8/2011 | Schmieg et al. | 60/286 |
| 2003/0140621 | A1 | 7/2003 | Khair et al. | |
| 2006/0218895 | A1 * | 10/2006 | Wickert | 60/277 |
| 2007/0089406 | A1 * | 4/2007 | Doring | 60/295 |

FOREIGN PATENT DOCUMENTS

| | | | |
|---|---|---|---|
| EP | 1426575 | A1 | 6/2004 |
| JP | 110936457 | A | 4/1999 |
| JP | 2003027924 | A | 1/2003 |

* cited by examiner

METHOD, DEVICE AND COMPUTER PROGRAM PRODUCT FOR DIAGNOSING AN OXIDATION CATALYST

BACKGROUND AND SUMMARY

The present invention proposes a method for diagnosing the function of an oxidation catalyst, for the conversion of NO into $NO_2$, during operation on board a vehicle, which oxidation catalyst is arranged in a vehicle containing an internal combustion engine which, during operation, emits exhaust gases to an exhaust gas aftertreatment system containing the aforementioned oxidation catalyst.

The present invention also proposes an engine-driven vehicle containing an internal combustion engine which, during operation, emits exhaust gases to an exhaust gas aftertreatment system containing an oxidation catalyst for the oxidation of NO to $NO_2$, an injection device for injection of a reducing agent into the exhaust gas aftertreatment system upstream of the oxidation catalyst, an $NO_x$-reducing catalyst and/or particulate filter arranged downstream of the oxidation catalyst, a gas sensor arranged at least downstream of the oxidation catalyst and a control unit for recording signals from the gas sensor and for controlling at least the injection device.

The present invention also proposes a computer program product containing a computer program intended to execute such a method with a computer.

Statutory requirements relating to diesel engines have been tightened and will be tightened further, in particular with regard to emissions of nitrogen oxide compounds and particulates. The quantity of oxides of nitrogen formed by the combustion of fuel in the cylinder of an engine is dependent on the temperature during combustion. Higher temperatures lead to the conversion of a larger proportion of the nitrogen present in the air into oxides of nitrogen. The catalysts that are used on diesel engines and other engines which operate with an excess of air are for the most part oxidizing catalysts. Because the exhaust gases contain oxygen, it is difficult to reduce the oxides of nitrogen with high selectivity. In addition to oxides of nitrogen, the undesired emissions carbon monoxide (CO), hydrocarbons (HC) and particulates inter alia are also formed during the combustion process primarily in the form of soot (C).

A previously disclosed method for reducing the quantity of oxides of nitrogen, and which is based on exhaust gas aftertreatment, is the LNA (Lean $NO_x$ Adsorber) $NO_x$ adsorber. LNA can also be referred to as LNT (Lean $NO_x$ Trap). The method is based on first oxidizing NO into $NO_2$ in an oxidation catalyst, after which the $NO_2$ is stored in the adsorber in the form of nitrates. The storage of $NO_2$ occurs when the engine is operating with an oxygen surplus. Regeneration of the $NO_x$ adsorber ($NO_x$-reducing catalyst) then occurs intermittently at predetermined intervals by causing the engine to operate with an oxygen deficiency, that is to say, with the addition of extra hydrocarbon (a reducing agent) and/or a reduced air flow, which destabilizes the nitrates and reduces the nitrogen dioxide $NO_2$ trapped in the $NO_x$ adsorber into nitrogen $N_2$ and water $H_2O$. See, for example, U.S. Pat. No. 5,473,887 or U.S. Pat. No. 6,718,757. Both the storage and the regeneration require the temperature in the NO: adsorber to be sufficiently high (more than 200° C. for storage and circa 300° C. for regeneration). At low loadings on the engine (e.g. urban driving or an unladed goods vehicle), the exhaust gas temperature will not be sufficient to maintain the $NO_x$ adsorber at the necessary temperature. One way of forcing the temperature up to the appropriate level is to inject hydrocarbons into the exhaust gas that is then burned catalytically in the $NO_x$ adsorber so that the right temperature is achieved. The hydrocarbons have a negative influence on the useful $NO_2$ formation, whereupon the total conversion of oxides of nitrogen in the exhaust gas system decreases during heating up. In accordance with the prior art, it is possible to control the injection in such a way that the hydrocarbon to all intents and purposes poisons the oxidation catalyst totally so that the formation of $NO_2$ in the oxidation catalyst is in principle non-existent.

If the oxidation catalyst for some reason has an impaired $NO_2$ formation function, a reduced quantity of $NO_2$ will be stored in the $NO_x$ adsorber and an increased quantity of $NO_x$ will be released into the atmosphere.

In conjunction with the supply of hydrocarbon, this can take place as an extra injection (post-injection) with an exhaust valve open in the engine or via an injector arranged on the exhaust pipe.

Another previously disclosed exhaust gas aftertreatment method, to which the formation of $NO_2$ through an oxidation catalyst is central, is CRT (Contmously Regenerating Trap). Particulates, that is to say soot and sulfur compounds, for example, are collected here in a trap, where the soot can be transformed into carbon dioxide $CO_2$. The $NO_2$ functions here as an oxidation agent in conjunction with the conversion of the particulates. In order to ensure that the soot combustion takes place with the help of $NO_2$, the temperature of the exhaust gas aftertreatment system needs to be above 250° C. Here, too, the temperature in the exhaust gas aftertreatment system can be increased to an appropriate level with the help of the addition of hydrocarbons that are burnt in the catalyst.

If the oxidation catalyst in the CRT for some reason has an impaired $NO_2$ formation function, a reduced quantity of soot will be oxidized in the particulate filter, which means that there is a risk that the particulate filter may become overcharged and that a sufficiently high temperature in the particulate filter can give rise to a soot fire, which, thanks to the increased quantity of soot that is burnt, can develop to such an extent that the particulate filter can be damaged.

Other previously disclosed exhaust gas aftertreatment techniques to which the formation of $NO_2$ is central are:

- LNC (Lean $NO_x$ Catalyst), in which oxides of nitrogen are reduced continuously under oxygen-rich conditions.
- Particulate filters coated with "washcoat".
- Urea or ammonia-based SCR (Selective Catalyst Reduction) for $NO_x$ reduction; see, for example, U.S. Pat. No. 5,540,047.
- Hydrocarbon-based (HC-based) SCR (Selective Catalyst Reduction).

In order to guarantee the function and, consequently, that the statutory requirements are met, various diagnoses are performed on board and during operation of the vehicle on parts of or on the entire exhaust gas aftertreatment system. EP1174601 illustrates an example of a diagnostics method for an exhaust gas aftertreatment system based on temperature measurements. A predetermined quantity of hydrocarbon HC is injected periodically. The exotherm is measured with a temperature sensor, that is to say a recording is made of the light-off temperature, and on the basis of the measured temperature values a decision is taken in respect of whether or not the exhaust gas aftertreatment system has an impaired function.

It is desirable to diagnose the oxidation catalyst and its formation of $NO_2$ on board and during operation of the vehicle, so that any malfunction can be identified in good time and any undesired exhaust gas emissions can be reduced in this way.

The method in accordance with the invention includes a diagnostics method performed during operation on board a vehicle and for an oxidation catalyst, for the oxidation of NO into $NO_2$, arranged in a vehicle with an internal combustion engine which, during operation, emits exhaust gases into an exhaust gas aftertreatment system containing at least the aforementioned oxidation catalyst and an $NO_x$-reducing catalyst arranged downstream of the oxidation catalyst, and a predetermined quantity of a reducing agent is supplied to the exhaust gas aftertreatment system during at least a predetermined time interval upstream of the oxidation catalyst, and the $NO_x$ content is measured downstream of the $NO_x$-reducing catalyst. The method is characterized by the following stages:

- a first measurement and recording are made of a first value for the $NO_x$ content at a point in time immediately before the reduction agent is supplied to the exhaust gas aftertreatment system;
- a second measurement and recording are made of a second value for the $NO_x$ content at a point in time during the period when the reduction agent is supplied to the exhaust gas aftertreatment system and poisons the aforementioned oxidation catalyst;
- a comparison is made between the aforementioned first and second values, in conjunction with which an indication of the impaired function of the oxidation catalyst is obtained when the difference between the aforementioned measured values is less than a predetermined first value.

An advantage that is obtained with the method in accordance with the invention is that oxidation of the catalyst function can be diagnosed continuously when the vehicle is in operation, and an indication is obtained in the event that oxidation of the catalyst function is impaired. A more stable exhaust gas aftertreatment function is obtained in this way, and a minimization of undesired exhaust gas emissions can be assured.

The invention also includes a device in the form of an engine-driven vehicle with an exhaust gas aftertreatment system in which the oxidation catalyst is diagnosed in accordance with the present invention.

The advantages achieved with the device in accordance with the invention are the same as with the method in accordance with the invention.

In an alternative embodiment of the method and the device in accordance with the invention, the difference is also compared with a second predetermined value, where the aforementioned second predetermined value corresponds to a limit for a statutory maximum permissible exhaust gas emission. If the difference is greater than the aforementioned second predetermined value and less than the aforementioned first predetermined value, the aforementioned indication will take place in conjunction with the vehicle's next regular service.

One advantage of this is that the flow of information to the vehicle's driver is reduced, and that workshop inspection and any repair of the exhaust gas aftertreatment system can take place in a more cost-effective way.

In another alternative embodiment of the method and the device in accordance with the invention, a particulate filter is arranged downstream of the oxidation catalyst, in conjunction with which the difference is instead compared with a third predetermined value. If the difference is less than this predetermined value, an indication of the impaired function of the oxidation catalyst is given immediately to the driver of the vehicle. This is because of the rapidly increasing risk of a future soot fire damaging the particulate filter.

In a further alternative embodiment of the method and the device in accordance with the invention, the $NO_2$ content is measured instead with the help of a gas sensor arranged downstream of the oxidation catalyst. Measuring the $NO_2$ content with a gas sensor is in itself previously disclosed. The characterizing stages are the same as in the corresponding embodiment referred to above, except that the $NO_2$ content is measured instead:

- a first measurement and recording of a first value for the $NO_2$ content are made at a point in time immediately before the reduction agent is supplied to the exhaust gas aftertreatment system;
- a second measurement and recording of a second value for the $NO_2$ content are made at a point in time during the period when the reduction agent is supplied to the exhaust gas aftertreatment system and poisons the aforementioned oxidation catalyst;
- a comparison is made between the aforementioned first and second values, in conjunction with which an indication of the impaired function of the oxidation catalyst is obtained when the difference between the aforementioned measured values is less than a predetermined first value.

The principal advantage is the same as for the corresponding embodiment described above.

DETAILED DESCRIPTION

Figure 1:
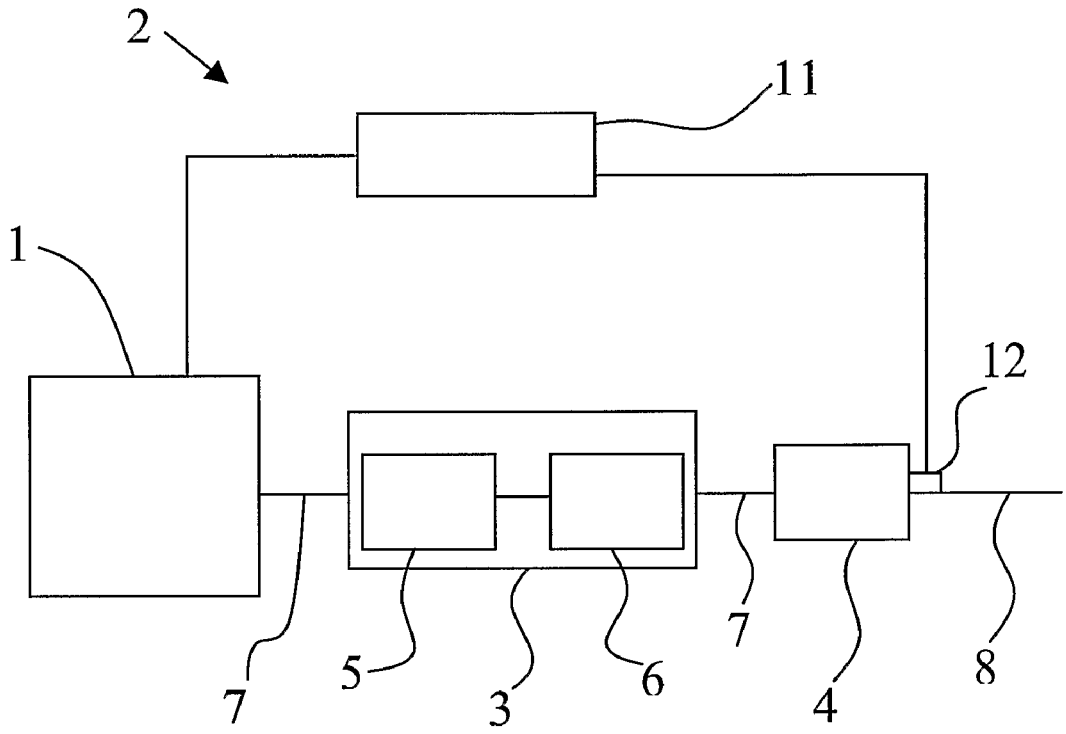
FIGS. 1 and 4 each illustrate a schematic representation of two different preferred embodiments of an exhaust gas aftertreatment system in accordance with the invention.

FIG. 1 illustrates a preferred embodiment of the invention, in which the combustion gases emerging from an internal combustion engine 1 are led into an exhaust gas aftertreatment system generally designated as 2. The engine 1 is an engine which operates with an oxygen surplus, for example a diesel engine of the piston-cylinder type, in which the oxygen surplus in the exhaust gases of the engine 1 is utilized to reduce the quantity of $NO_x$ and particulates (mainly soot) in the exhaust gases before they are released into the atmosphere. The exhaust gas aftertreatment system 2 is so arranged as to reduce the quantity of oxides of nitrogen and particulates in the exhaust gases of the engine 1. The central components in the exhaust gas aftertreatment system 2 comprise a CRT™ 3 and an $NO_x$-reducing catalyst 4. In the illustrative embodiment shown here, the CRT 3 comprises an oxidation catalyst 5 and a particulate filter 6. The $NO_x$-reducing catalyst 4 is of the LNA type in the illustrative embodiment shown here. The exhaust gases from the engine 1 are led in turn via an exhaust pipe 7 through a first stage in the form of the oxidation catalyst 5, a second stage in the form of the particulate filter 6 and finally a third stage in the form of the $NO_x$-reducing catalyst 4. The exhaust gases are led out from the catalyst 4 into the atmosphere via the output pipe 8.

The exhaust gases from the engine 1 typically comprise various oxides of nitrogen $NO_x$, such as NO and $NO_2$, but also hydrocarbons HC, carbon monoxide CO, carbon dioxide $CO_2$, particulates and other combustion residues. The oxidation catalyst 5 in the first stage is preferably coated with a precious metal such as platinum or palladium, but can also contain metal oxides. In the course of its normal function, the oxidation catalyst 5 oxidizes the greater proportion of the NO in the exhaust gases into $NO_2$. The reaction in the first stage is described by the formula 1:

$$NO+\tfrac{1}{2}O_2 \rightarrow NO_2 \quad 1)$$

This results in the formation of $NO_2$, which is then conveyed into the second stage comprising the particulate filter 6, for example of the ceramic monolith type, in which the channels are plugged so that the gas must pass through a channel wall. In the particulate filter 6, $NO_2$ from the oxidation catalyst 5 reacts with particulates in the exhaust gas, which particulates are predominantly in the form of soot, so that at least a proportion of the $NO_2$ is reduced to NO, that is to say nitrogen monoxide, at the same time as the soot is oxidized to $CO_2$. The quantity of NO2 that is reduced depends on the soot content of the exhaust gas and the quantity of soot that has become trapped in the filter. The reduction of $NO_2$ to NO is thus not one-hundred-per-cent complete. The exhaust gases that emerge from the particulate filter generally comprise both $NO_2$ and reduced $NO_2$, that is to say NO, and $CO_2$. The reaction in stage two can be expressed essentially through formula 2:

$$2NO_2+C \rightarrow 2NO+CO_2 \quad 2)$$

The exhaust gases from the filter 6 then continue into the third stage, that is to say the $NO_x$-reducing catalyst 4. The $NO_x$-reducing catalyst 4 in the illustrative embodiment shown here is an LNA, that is to say an $NO_x$ adsorber, so arranged as to collect on it the remaining quantity of $NO_2$ under oxygen-rich conditions, which catalyst 4 with the addition of a reducing agent reduces the nitrogen dioxide $NO_2$ trapped in the $NO_x$ adsorber to nitrogen $N_2$ and water $H_2O$ in gaseous form. The main process in stage three can be expressed through formula 3:

$$3NO_2+2H_2C \rightarrow 1\tfrac{1}{2}N_2+2H_2O+2CO_2 \quad 3)$$

The $NO_\chi$-reducing catalyst 4 can be coated with a catalytic layer, the purpose of which is to oxidize any NO remaining from stage 2 to $NO_2$ , which $NO_2$ can then be stored in the $NO_x$-reducing catalyst 4.

In an alternative embodiment, the $NO_x$-reducing function can be integrated into the particulate filter (4-way catalyst) by coating the walls of the particulate filter with a suitable catalytic layer. Furthermore, the particulate filter can be of the metal substrate type with plugged or non-plugged channels. The aforementioned reducing agent or heating medium in the illustrative embodiment shown here preferably comprises the fuel for the engine 1 and can be stored in a single tank (not shown) to enable it to be sprayed as required into the exhaust pipe 7 with an injector (not shown) arranged upstream of the oxidation catalyst 5. The injector is controlled by a control unit 11, which can also be so arranged as to control the combustion process of the engine 1. In an alternative embodiment, the reduction agent can be injected through the standard fuel injectors (not shown) of the engine 1. The reduction agent in this embodiment preferably comprises the vehicle's regular fuel and is injected appropriately through a so-called post-injection, which is controlled and regulated by the control unit 11.

In the illustrative embodiment shown here, the control unit 11 receives signals from an $NO_x$ sensor 12 arranged downstream of the catalyst 4. The $NO_x$ sensor 12 senses the quantity of $NO_x$ in the exhaust gases.

Figure 2:
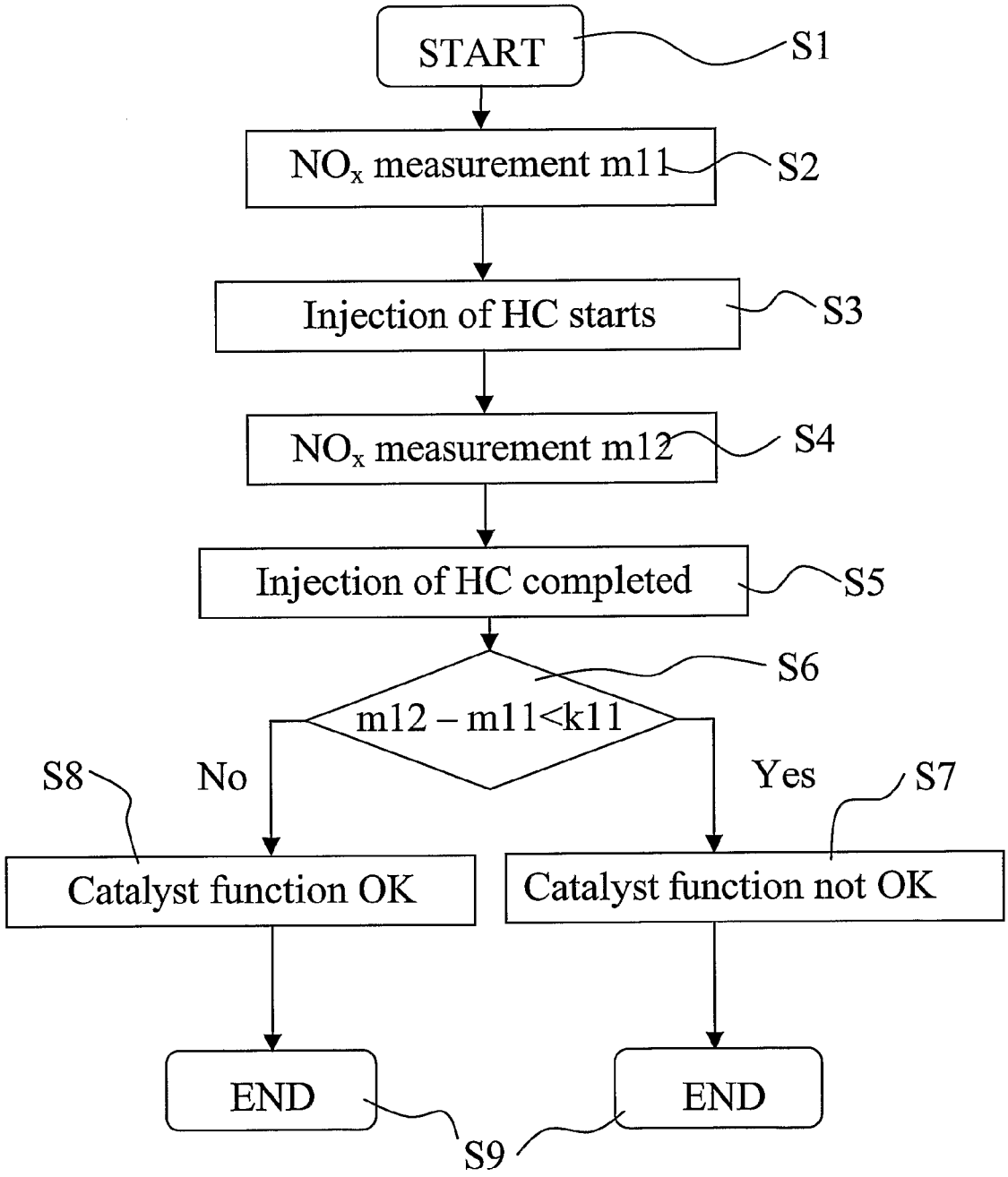
FIGS. 2, 3 and 5 illustrate flow charts for the respective embodiments illustrated in FIGS. 1 and 4.

In accordance with the present invention, a diagnosis of the oxidation of the catalyst 5 can be made in accordance with one embodiment and, in the event that the $NO_\chi$-reducing catalyst 4 is coated with a catalytic layer for the purpose of oxidizing any NO remaining from stage 2 into $NO_2$, a diagnosis of the oxidizing capacity of the catalyst 4 is also performed in accordance with the flow chart illustrated in FIG. 2. The control unit 11 in this case is programmed to perform at least the stages illustrated in FIG. 4. When the control unit 11 identifies that a certain operating period has passed since the immediately preceding diagnosis, and that it is expected to be possible to maintain a relatively stationary engine status in the immediate future, the diagnosis is started in S1 in FIG. 2. In stage S2, the control unit 11 performs a measurement of the $NO_x$ content via the sensor 12. In a normal oxidation catalyst function, a low value is obtained here for the first measured value mil, since the greater part of the $NO_x$ must have been transformed (in accordance with the above). When a value for mil has been measured and stored in the control unit 11, the oxidation catalyst 5 is poisoned, and also the oxidizing function that is possibly built into the $NO_x$-reducing catalyst 4, by the control unit 11 injecting a reducing agent in stage S3 in the illustrative embodiment shown here through a post injection with the help of the standard fuel injectors (not shown) of the engine 1. The quantity of the injected reduction agent is predetermined and adapted so that the oxidation of NO into $NO_2$ in the exhaust gas aftertreatment system 2 ceases preferably entirely, or to all intents and purposes entirely. When the oxidation of NO into $NO_2$ is expected to have ceased sufficiently, the control unit 11 performs a new measurement of the $NO_x$ content in stage S4 with the help of the sensor 12, and a value ml2 for the $NO_x$ content is obtained and stored in the control unit 11. In stage S5, the control unit 11 terminates the injection of the reduction agent. The control unit 11 performs a calculation of the difference between the measured values mil and ml2 in stage S6 and then compares the difference with a predetermined value kll. In a normal oxidation function, the calculated difference is relatively large, since the oxidation of NO into $NO_2$ is to all intents and purposes complete and the $NO_x$ measurement mil has a relatively low value. If, on the other hand, the oxidation function is reduced, the difference will then be smaller. The poorer the oxidation function, the smaller will be the difference between the measured values ml2 and mil. If the difference is calculated to be less than a certain predetermined value kll (limit value), the control unit 11 will indicate by selecting stage S7 that the oxidation function has been impaired to such an extent that it cannot be said to be OK. If, on the other hand, the control unit 11 in S6 calculates that the difference is greater than the predetermined value kll, the control unit 11 will instead choose to indicate in stage S8 that the oxidation function is OK. In S9 the control unit 11 terminates the cycle in accordance with the embodiment in FIG. 2.

The predetermined value kll is arrived at having regard for the various parts of the exhaust gas aftertreatment system and having regard for an acceptable oxidation function, that is to say an oxidation function which leads to acceptable exhaust gas cleaning. For example, since the illustrative embodiment in accordance with FIG. 1 contains a particulate filter 6, it is appropriate to take account of the performance of the particulate filter when determining the predetermined value kll, so that a certain impaired oxidation function does not lead to a damaging soot fire, that is to say without an indication that a fault exists being obtained from the control unit 11.

The condition of the engine 1 and/or the exhaust gas aftertreatment system 2 should be relatively stationary from the point at which the measurement in stage S2 commenced and until the point at which the measurement in S4 was performed, in order to obtain good measured values. In a preferred embodiment, the control unit 11 can be given the possibility, after the measurements in S2 and S4 have been carried out, to establish whether or not the condition of the engine 1 and/or the exhaust gas aftertreatment system 2 has changed during the measurements. If a more significant change in the condition of the engine 1 and/or the exhaust gas aftertreatment system 2 has taken place during the period for which the measurements continued, the control unit 11 can then be so arranged as to reject the result of the measurements and to select to perform at least one or more further new cycles of measurements and comparisons of calculated differences in relation to kll. Several completed cycles will provide a better statistical basis for a diagnosis of the function of the oxidation catalyst.

In an alternative embodiment, the control unit 11 in stage S6 can be so arranged, instead of calculating a difference, as to calculate the ratio between the measured values mil and ml2. If the ratio is closer to the value one than a certain predetermined value kll, the control unit 11 then indicates that a fault may be present in the function of the oxidation catalyst. The diagnosis can also be performed with advantage in a temperature range that is beneficial having regard for the product selectivity of the catalyst. If this is not possible, the predetermined value kll can take account of such a condition. That is to say, the value kll can vary for different operating cases and conditions.

Figure 3:
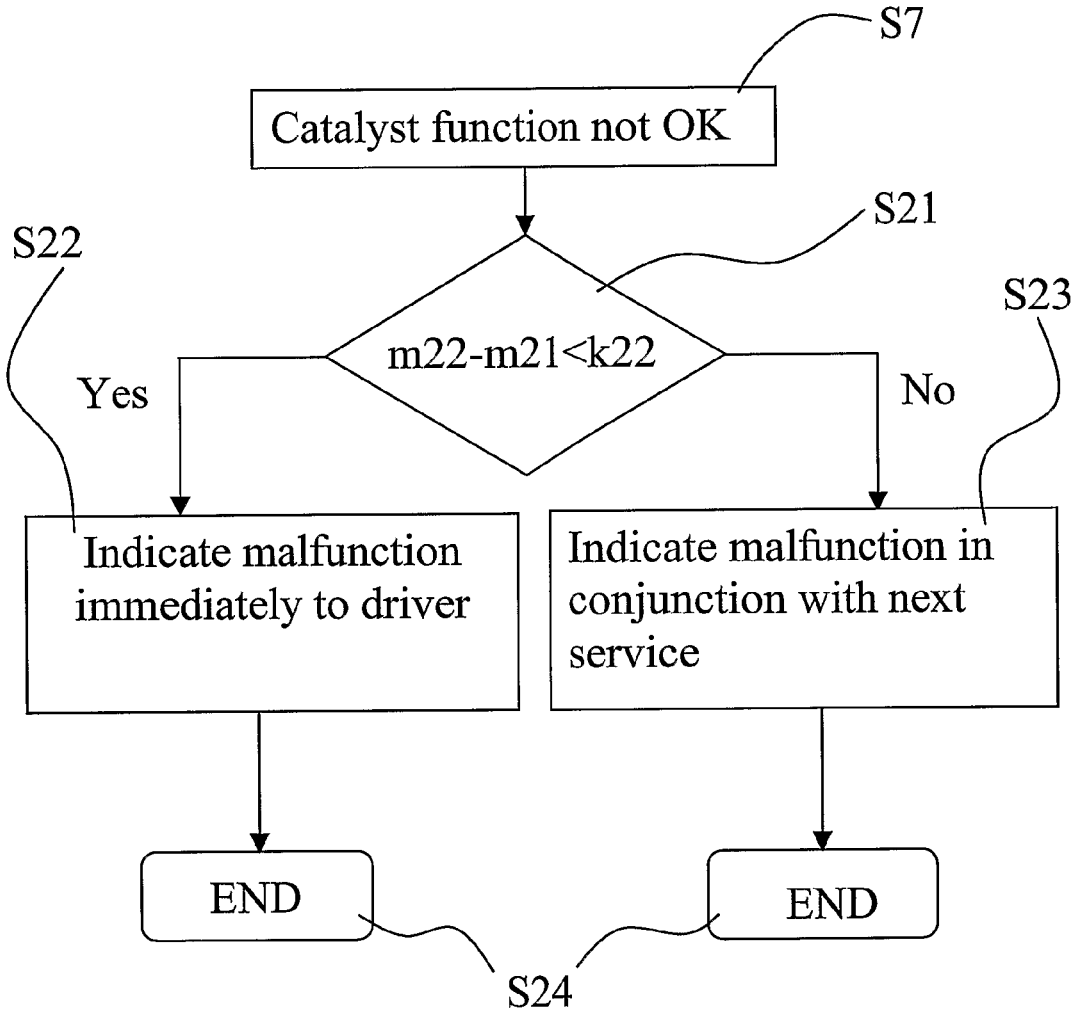

Illustrated in FIG. 3 is a further alternative embodiment of the invention containing a further stage, which the control unit 11 can be so arranged as to execute if the function of the oxidation catalyst was not found to be OK in accordance with S7 in FIG. 2. In this embodiment the control unit 11 so arranged, after establishing in stage S7 that the oxidation function of the catalyst is not OK, as to make a new comparison in stage S21 with a further predetermined limit value k22. The value k22 is predetermined at a value which corresponds to the limit for the statutory maximum permissible exhaust gas emissions, kll is preferably greater than k22. The statutory value k22 thus permits a more impaired oxidation catalyst function than kll. If the difference between m22 and m21 in accordance with stage S21 is also less than k22, a malfunction in accordance with stage S22 is indicated as soon as possible to the driver of the vehicle. If, on the other hand, the difference in S21 is greater than k22 (but less than kll), the control unit 11 is so arranged in accordance with stage S23 as not to indicate the malfunction of the oxidation catalyst until the vehicle's next service. This is based on the assumption that a new diagnosis will not be made before the service is carried out, where the difference in S21 is less than the statutory k22. When the control unit 11 has processed stages S22 or S23, termination of the program is reached in stage S24.

Figure 4:
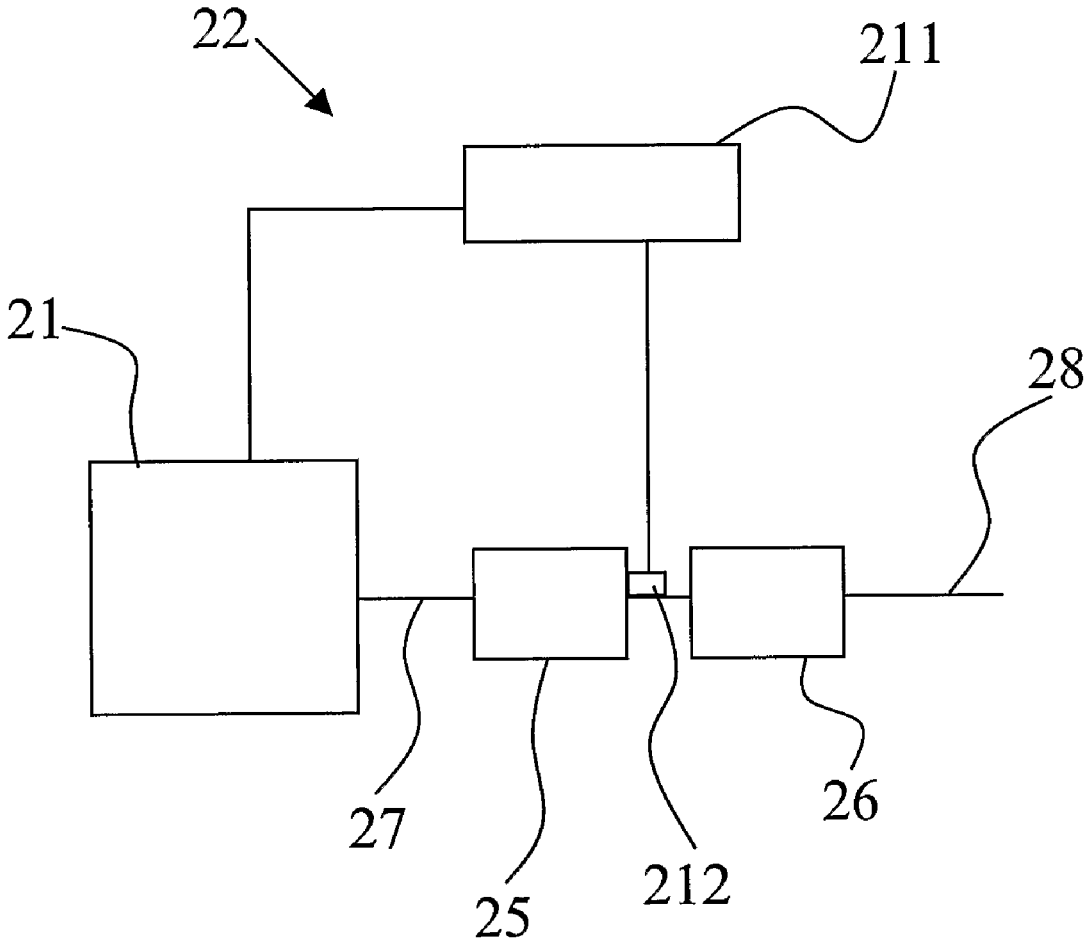

FIG. 4 illustrates an alternative preferred embodiment of the invention in which the combustion gases emerging from an internal combustion engine 21, as shown in the embodiment in accordance with FIG. 1, are led into an exhaust gas aftertreatment system generally designated as 22. The exhaust gases are led in here, in the same way as in the embodiment in accordance with FIG. 1, through the exhaust pipe 27 and into an oxidation catalyst 25. The exhaust gases are then conveyed to an exhaust gas aftertreatment unit 26, which can be a particulate filter or an $NO_x$-reducing catalyst, both of a type that requires $NO_2$ for its emissions-reducing function. A gas sensor 212, which measures $NO_2$ (instead of the $NO_x$ content as described above), is arranged directly after the oxidation catalyst 25, that is to say between the oxidation catalyst 25 and the exhaust gas aftertreatment unit 26. The gas sensor transmits signals for the measured $NO_2$ content to a control unit 211. The control unit 211, like the control unit 11 (FIG. 1), can be so arranged as to control the combustion process of the engine 21. Here, as in the embodiment in accordance with FIG. 1, the reduction agent can also be injected directly into the exhaust pipe 27 upstream of the oxidation catalyst 25, or alternatively through the standard fuel injectors (not shown) of the engine 21. The reduction agent in this embodiment preferably comprises the vehicle's regular fuel and is injected appropriately through a so-called post injection, which is controlled and regulated by the control unit 211.

In a further embodiment, based on the embodiment in accordance with FIG. 4, the gas sensor 212 can be arranged downstream of both the oxidation catalyst 25 and the exhaust gas aftertreatment unit 26.

Figure 5:
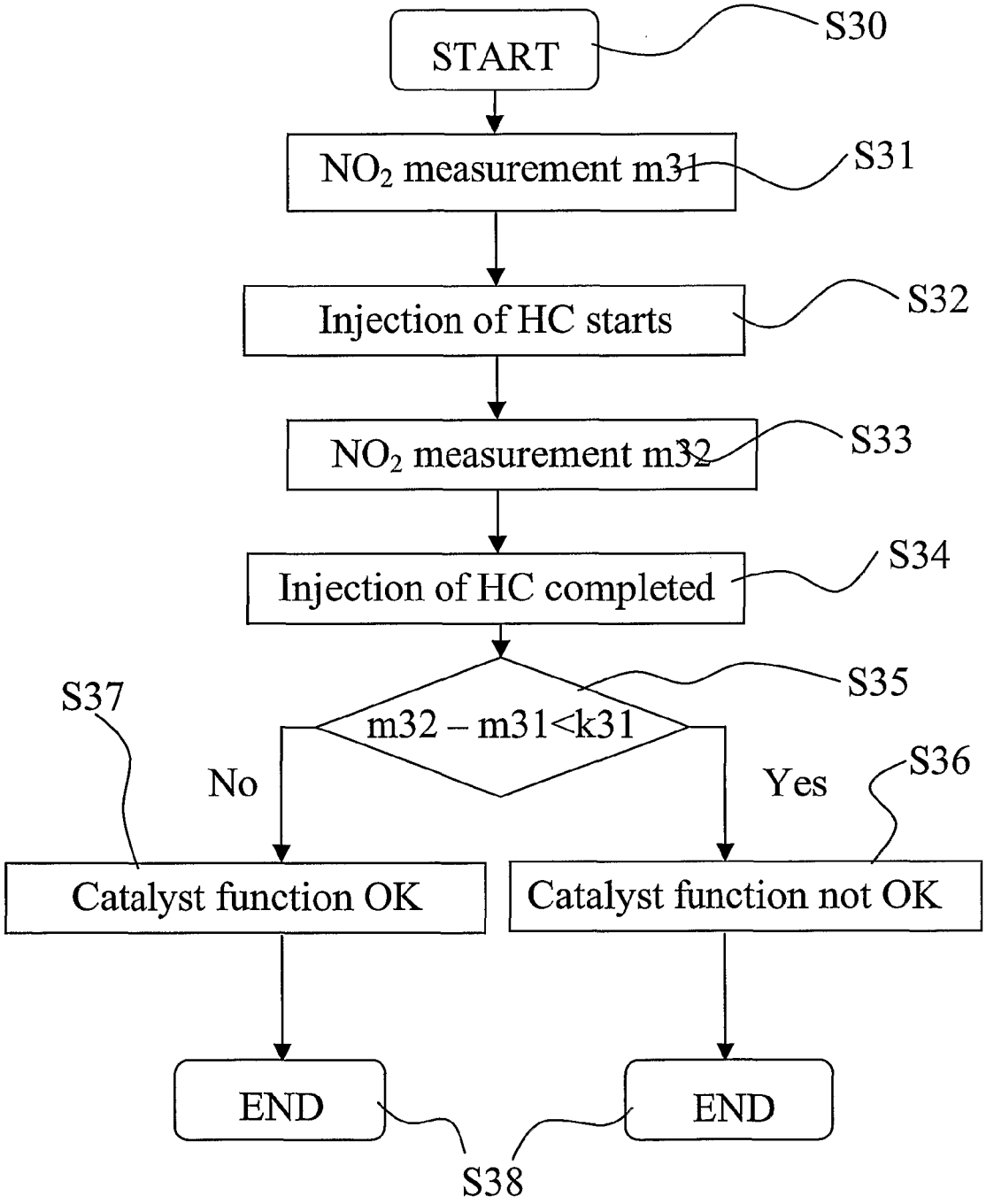
Figure 6:
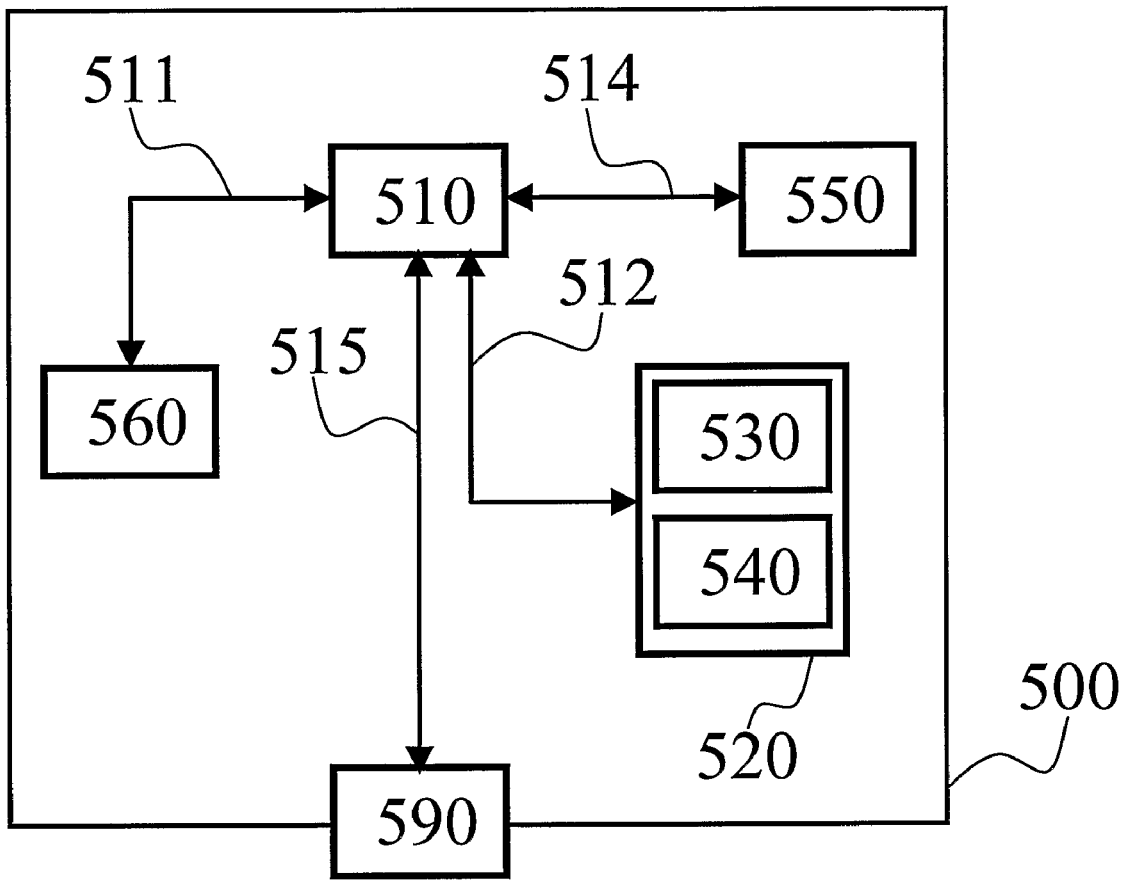
FIG. 6 illustrates an apparatus which can be used at least in the embodiments illustrated in FIGS. 1 and 4.

In accordance with the present invention, in accordance with one embodiment, a diagnosis of the oxidation of the oxidizing capability of the catalyst 25 can be performed in accordance with the flow chart illustrated in FIG. 5. The flow chart is identical with the flow chart in accordance with the above shown in FIG. 2. The only difference is that, in the measurement in stage S32 with the help of the gas sensor 212, a measured value for the $NO_2$ content is stored instead. The NO2 content is also measured in the same way in stage S33. Compared with FIG. 2, the embodiment in accordance with FIG. 5 thus differs in the sense that a difference for $NO_2$ is calculated in S35 by the control unit 211. In other respects, therefore, stages S30 to S38 take place in the same way as in accordance with the embodiment in FIG. 2.

A further embodiment of the invention, based on the embodiment in accordance with FIG. 5, can be a corresponding control algorithm which, in accordance with the embodiment in FIG. 3, is also built into the embodiment in accordance with FIG. 5, that is to say that the control unit 211 also takes account of statutory requirements and takes decisions in respect of whether or not the indication "catalyst function not OK" will be postponed until the next service.

In an alternative embodiment of the invention, a third measurement (not shown) of the $NO_x$ content can be performed after the injection of the reduction agent has been completed. The control unit (11, 211) in accordance with the embodiments shown in the figures can be so arranged as to compare the first measured value (mil, m31) with the third measured value. If the control unit identifies a difference between the first value and the third value, this can indicate that some external factor may have influenced the measurement procedure. Normally the $NO_x$ content before (the first value) and after (the third value) injection of the reducing agents must be identical. In the event of a significant difference between the values, the control unit is so arranged as to repeat the measurement and the recording for at least the most recently measured first and second value (mil, m31 and ml2, m32 respectively).

In situations in which the $NO_x$-reducing catalyst is not active, for example in the cold-start sequence, or when the function of the catalyst is deliberately switched off (in SCR, for example, to ensure that the reductant is not supplied to the SCR catalyst), the $NO_x$ signal from an $NO_x$ sensor with a functional (active) oxidation catalyst will be lower during the period for which the reduction agent is injected, compared with immediately before the reduction agent begins to be injected. How much lower the signal is will depend on the degree of function of the oxidation catalyst. If the oxidation catalyst is not functioning for some reason, no difference will be present in the $NO_x$ sensor signal during the period for which the reduction agent is injected, compared with immediately before injection of the reducing agent. Thus, in a further embodiment of the invention, the control unit can be so arranged as to identify that the $NO_x$-reducing function is not active, and also to perform a comparison of the $NO_x$ sensor signal before injection of the reducing agent and during the period when injection of the reducing agent takes place and, depending on the difference in the $NO_x$ content, to determine the oxidation function of the catalyst. The aforementioned method of controlling the oxidation catalyst can also function for embodiments which lack an $NO_x$ reducing catalyst.

FIG. 5 illustrates an apparatus 500, in accordance with an embodiment of the invention, containing a nonvolatile memory 520, a processor 510 and a read-and-write memory 560. The memory 520 has a first memory part 530, in which a computer program for controlling the apparatus 500 is stored. The computer program in the memory part 530 for controlling the apparatus 500 can be an operating system.

The apparatus 500 can be enclosed, for example, in a control unit, such as the control unit 11 or 211. The data processing unit 510 can include a microcomputer, for example.

The memory 520 also has a second memory part 540, in which a program for the diagnosis of an oxidation catalyst in accordance with the invention is stored. In an alternative embodiment, the program for the diagnosis of an oxidation catalyst is stored in a separate non-volatile data storage medium 550, such as a CD-ROM or a replaceable semiconductor memory, for example. The program can be stored in an executable form or in a compressed state.

Since it is described below that the data processing unit 510 runs a special function, it should be clear that the data processing unit 510 runs a special part of the program which is stored in the memory 540, or a special part of the program which is stored on. the nonvolatile recording medium 550.

The data processing unit 510 is adapted for communication with the memory 550 via a data bus 514. The data processing unit 510 is also adapted for communication with the memory 520 via a data bus 512. The data processing unit 510 is also adapted for communication with the memory 560 via a data bus 511. The data processing unit 510 is also adapted for communication with a data port 590 by means of a data bus 515.

The method in accordance with the invention can be performed by the data processing unit 510, in that the data processing unit 510 runs the program which is stored in the memory 540, or the program which is stored in the nonvolatile recording medium 550.

In an alternative embodiment of the invention, the oxidation catalyst 5 can be integrated with the particulate filter 6. Parts or all of the particulate filter can be coated with a catalytically active material which oxidizes NO to $NO_2$. In a similar way, the oxidation catalyst 25 can be integrated with the exhaust unit 26.

In an alternative embodiment of the invention, the CRT (or PM-F-catalyst) and the $NO_x$-reducing catalyst in accordance with the embodiment in FIG. 1 can be arranged in the exhaust gas aftertreatment system 2 in the opposite sequence.

In a further alternative embodiment of the invention, injection of a reducing agent can take place simultaneously through both the engine's injectors and one or more injectors arranged on the exhaust gas aftertreatment system.

The invention in accordance with the present application can also be applied with advantage, in addition to the exhaust gas aftertreatment methods already mentioned, to at least the following:

LNC (Lean $No_x$ Catalyst) in which oxides of nitrogen are reduced continuously under oxygen-rich conditions.

Precious metal- and/or metal oxide-coated particulate filter.

Hydrocarbon-based (HC-based) SCR (Selective Catalyst Reduction).

Urea or ammonia-based SCR (Selective Catalyst Reduction).

The reduction agent injected into the exhaust gas aftertreatment system is with advantage the vehicle's fuel, which can be diesel, petrol, dimethyl ether (DME), methane (CNG), etc., although in the case of an injector on the exhaust pipe, it can also conceivably be a reducing agent from a separate tank, which reducing agent is not used for propulsion of the vehicle. In addition to a reducing agent in the form of hydrocarbon, the use of hydrogen ($H_2$) and carbon monoxide (CO) is also possible.

The invention must not be regarded as being restricted to the illustrative embodiments described above, but a series of further variants and modifications is conceivable within the scope of the following patent claims.

The invention claimed is:

1. A diagnostics method performed during operation on board a vehicle and for an oxidation catalyst, for the oxidation of NO into $NO_2$, arranged in a vehicle with an internal combustion engine which, during operation, emits exhaust gases to an exhaust gas aftertreatment system containing at least the oxidation catalyst and at least one of a $NO_x$-reducing catalyst and a particulate filter arranged downstream of the oxidation catalyst, comprising:

adding a predetermined quantity of a reduction agent to the exhaust gas aftertreatment system during at least one predetermined time interval upstream of the oxidation catalyst;

measuring one of $NO_x$ content and $NO_2$ content downstream of the oxidation catalyst;

making a first measurement of and recording a first value for one of the $NO_x$ content and $NO_2$ content at a point in time before the reduction agent is supplied to the exhaust gas aftertreatment system;

making a second measurement of and recording a second value for one of the $NO_x$ content and $NO_2$ content at a point in time during the time interval when the reduction agent is supplied to the exhaust gas aftertreatment system, where the supply of reduction agent temporarily poisons the oxidation catalyst so that a quantity of $NO_2$ produced is negligible;

comparing the first and second values and obtaining an indication of impaired function of the oxidation catalyst when a difference between the first and second values is less than a predetermined first value.

2. The diagnostics method as claimed in claim 1, wherein a particulate filter is arranged downstream of the oxidation catalyst, and wherein, when the difference is less than a predetermined second value, an indication of impaired function of the oxidation catalyst is given to a driver of the vehicle.

3. A computer program product containing program code stored on a non-transitory computer-readable medium for performing the method in claim 1.

4. A computer program product on a non-transitory medium capable of being loaded directly into an internal memory in a computer, containing computer programs for performing the method stages as claimed in claim 1.

5. The diagnostics method as claimed in claim 1, wherein, when the difference is less than the predetermined first value, and, providing at least one of an indication of impaired function of the oxidation catalyst to a driver of the vehicle or in conjunction with the vehicle's next service.

6. The diagnostics method as claimed in claim 5, wherein, if the difference is greater than a predetermined second value and less than the predetermined first value, the indication of impaired function will take place in conjunction with the vehicle's next regular service.

7. The diagnostics method as claimed in claim 1, wherein the measurements of the $NO_2$ content are performed between the oxidation catalyst and the at least one of the $NO_x$-reducing catalyst and the particulate filter arranged.

8. The diagnostics method as claimed in claim 7, wherein the particulate filter is arranged downstream of the oxidation catalyst, and wherein, when the difference is less than a predetermined second value, an indication of the impaired function of the oxidation catalyst is given to the driver of the vehicle.

9. An engine-driven vehicle comprising:

an internal combustion engine;

an exhaust gas aftertreatment system to which, during operation, the engine emits exhaust gases, the system comprising an oxidation catalyst for oxidation of NO into $NO_2$, and at least one of a $NO_x$-reducing catalyst and a particulate filter arranged downstream of the oxidation catalyst, an injection device for injection of a reduction agent into the exhaust gas aftertreatment system upstream of the oxidation catalyst, at least one of a $NO_x$ and $NO_2$ sensor arranged downstream of the $NO_x$-reducing catalyst and the oxidation catalyst, a control unit for recording signals from the at least one of the $NO_x$ and $NO_2$ sensor and for controlling at least the injection device, wherein the control unit is so arranged as to record a first value for the at least one of a $NO_x$ and $NO_2$ content via the at least one of the $NO_x$ and $NO_2$ sensor at a point in time before injection of the reduction agent and a second value for the at least one of the $NO_x$ and a $NO_2$ content at a point in time during a period when injection of the reduction agent takes place and poisons the oxidation catalyst, the control unit being arranged to compare the first and second values and to indicate impaired function of the oxidation catalyst when the difference between the measured values is less than a predetermined first value.

10. The engine-driven vehicle as claimed in claim 9, comprising a particulate filter arranged downstream of the oxidation catalyst, wherein, when the difference is less than a predetermined second value, the control unit is arranged to indicate a reduced oxidation catalyst function to the driver of the vehicle.

11. The engine-driven vehicle as claimed in claim 9, wherein the $NO_2$ sensor is arranged between the oxidation catalyst and an exhaust gas aftertreatment unit arranged downstream of the oxidation catalyst.

12. The engine-driven vehicle as claimed in claim 9, comprising the particulate filter arranged downstream of the oxidation catalyst, wherein when the difference is less than a predetermined second value, the control unit is so arranged as to indicate impaired function of the oxidation catalyst to the driver of the vehicle.

13. The engine-driven vehicle as claimed in claim 9, wherein, when the difference is less than the predetermined first value, the control unit is arranged to indicate the impaired function of the oxidation catalyst at least one of to a driver of the vehicle or in conjunction with the vehicle's next service.

14. The engine-driven vehicle as claimed in claim 13, wherein, if the difference is greater than a second predetermined value and is less than the predetermined first value, the control unit is arranged to perform the indication of impaired function in conjunction with the vehicle's next regular service.

* * * * *